US010221032B2

(12) United States Patent
Tan et al.

(10) Patent No.: US 10,221,032 B2
(45) Date of Patent: Mar. 5, 2019

(54) BILL COLLECTING AND RECYCLING BOX

(71) Applicant: GRG Banking Equipment Co., Ltd., Guangzhou, Guangdong (CN)

(72) Inventors: Dong Tan, Guangdong (CN); Heng Liu, Guangdong (CN); Hongjun Wu, Guangdong (CN); Zhuang Jiang, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 1 day.

(21) Appl. No.: 15/571,810

(22) PCT Filed: May 11, 2016

(86) PCT No.: PCT/CN2016/081693
§ 371 (c)(1),
(2) Date: Nov. 3, 2017

(87) PCT Pub. No.: WO2016/180336
PCT Pub. Date: Nov. 17, 2016

(65) Prior Publication Data

US 2018/0137710 A1 May 17, 2018

(30) Foreign Application Priority Data

May 12, 2015 (CN) ..... 2015 1 0239922

(51) Int. Cl.
*B65H 29/14* (2006.01)
*B65H 29/52* (2006.01)
(Continued)

(52) U.S. Cl.
CPC ..... *B65H 29/52* (2013.01); *B65H 29/14* (2013.01); *B65H 31/10* (2013.01); *B65H 31/36* (2013.01);
(Continued)

(58) Field of Classification Search
CPC ..... B65H 31/26; B65H 83/025; B65H 29/52; B65H 31/36; G07D 11/0012
See application file for complete search history.

(56) References Cited

U.S. PATENT DOCUMENTS 4,753,431 A * 6/1988 Fujimoto ..... B65H 3/06 271/111
5,421,443 A 6/1995 Hatamachi et al.
(Continued)

FOREIGN PATENT DOCUMENTS

CN 101093590 A 12/2007
CN 101342999 A 1/2009
(Continued)

OTHER PUBLICATIONS

International Search Report and Written Opinion for Application No. PCT/CN2016/081693 dated Aug. 8, 2016.
(Continued)

*Primary Examiner* — Jeremy R Severson
(74) *Attorney, Agent, or Firm* — Wolf, Greenfield & Sacks, P.C.

(57) ABSTRACT

A banknote collecting and recycling box includes a box body including a door body having a banknote inlet, a banknote conveying passage, a conveying mechanism and a banknote stacking plate. The conveying mechanism is close to the banknote inlet and includes a driving shaft roller, a steering shaft roller in interference fit with the driving shaft roller, an outlet driving shaft roller away from the banknote inlet and in interference fit with the steering shaft roller, and a flapping vaned wheel coaxially arranged with the outlet driving shaft roller. The banknote stacking plate is supported by a spring on a bottom plate in the box body and slidable up and down, a side, facing the banknote stacking plate, of the first passage plate is provided with a guiding elastic
(Continued)

piece, and a Y-shaped passage is formed by the guiding elastic piece and the banknote stacking plate.

6 Claims, 7 Drawing Sheets

(51) Int. Cl.
*B65H 83/02* (2006.01)
*B65H 31/36* (2006.01)
*G07D 11/00* (2019.01)
*B65H 31/10* (2006.01)

(52) U.S. Cl.
CPC ..... *B65H 83/025* (2013.01); *G07D 11/00* (2013.01); *G07D 11/0012* (2013.01); *G07D 11/0021* (2013.01); *B65H 2301/421* (2013.01); *B65H 2701/1912* (2013.01); *G07D 11/0084* (2013.01); *G07D 2211/00* (2013.01)

(56) References Cited

U.S. PATENT DOCUMENTS

| | | | | |
|---|---|---|---|---|
| 6,991,228 | B2 * | 1/2006 | Schaareman | B65H 29/68 271/220 |
| 7,029,008 | B2 * | 4/2006 | Nishida | B65H 31/10 271/215 |
| 7,850,165 | B2 * | 12/2010 | Nagura | B65H 31/18 271/177 |
| 7,942,401 | B2 * | 5/2011 | Jeong | B65H 3/06 271/3.08 |
| 7,971,775 | B2 * | 7/2011 | Saltsov | G07D 11/0006 109/45 |
| 8,240,663 | B2 * | 8/2012 | Kramer | B65H 31/10 271/214 |
| 8,752,827 | B2 * | 6/2014 | Lee | B65H 31/36 271/207 |
| 9,290,353 | B2 * | 3/2016 | Deguchi | B65H 29/006 |
| 2008/0006564 | A1 | 1/2008 | Jeong | |
| 2009/0014946 | A1 | 1/2009 | Nagura et al. | |
| 2014/0124334 | A1 * | 5/2014 | Sado | B65H 5/062 198/604 |
| 2014/0265107 | A1 | 9/2014 | Kang et al. | |

FOREIGN PATENT DOCUMENTS

| | | | |
|---|---|---|---|
| CN | 101397102 | A | 4/2009 |
| CN | 101685557 | A | 3/2010 |
| CN | 201438025 | U | 4/2010 |
| CN | 201489596 | U | 5/2010 |
| CN | 101894415 | A | 11/2010 |
| CN | 102745536 | A | 10/2012 |
| CN | 104794807 | A | 7/2015 |
| EP | 2 043 059 | A2 | 4/2009 |
| JP | 2008-021113 | A | 1/2008 |
| JP | 2010-195574 | A | 9/2010 |
| KR | 101260332 | B1 | 5/2013 |
| WO | WO 2014/181622 | A1 | 11/2014 |
| WO | WO 2014/188805 | A1 | 11/2014 |
| WO | WO 2016/180336 | A1 | 11/2016 |

OTHER PUBLICATIONS

Extended European Search Report dated May 4, 2018 in connection with European Application No. 16792186.5.

* cited by examiner

BILL COLLECTING AND RECYCLING BOX

The present application is the national phase of International Application No. PCT/CN2016/081693, titled "BILL COLLECTING AND RECYCLING BOX", filed on May 11, 2016, which claims priority to Chinese patent application No. 201510239922.2 titled "BANKNOTE COLLECTING AND RECYCLING BOX", filed with the Chinese State Intellectual Property Office on May 12, 2015, the entire disclosures of both applications are incorporated herein by reference.

FIELD

The present application relates to the sheet-like medium processing technology, in particular to a recycling box applicable for a financial self-service device and used for recycling banknotes which are no longer suitable for further processing.

BACKGROUND

In a financial self-service device, in order to inspect every piece of banknotes processed in batches individually, the whole stack of banknotes stored in a cash box are required to be separated individually, and a recognition means, such as an image recognition, a thickness detection and a magnetic information detection, is used to inspect a separated single banknote to determine whether the banknote being processed is suitable for further processing; and the banknote, which has been compared and determined to be not suitable for further processing, is required to be recycled into a specialized banknote recycling box in the financial self-service device, to facilitate a staff member to manually check and process.

In conventional banknote recycling boxes, as an example, a cash recycling system disclosed in Chinese Patent No. 201489596U includes a recycling box module for storing banknotes not suitable to be supplied to a client. The recycling box includes at least two banknote inlets, at least two storing regions and an inner conveying passage. The inner conveying passage is in communication with at least one of the banknote inlets and at least one of the storing regions, and configured to convey the banknotes into the storing region from the banknote inlet.

However, a banknote stacking mechanism of the above-mentioned recycling box is complicated, thus having a low stability, a high cost and a low operation convenience during use.

SUMMARY

In view of the above problems in the conventional technology, an object of the present application is to provide a simplified banknote collecting and recycling box having a stacking mechanism, to allow the banknote collecting and recycling box to have an increased stability, reduced cost and improved operation convenience.

A banknote collecting and recycling box includes:

a box body including a movable door body, wherein the following components are installed inside the box body to form a banknote accommodating space, and a banknote inlet configured to allow entrance of banknotes is provided in the box body;

a banknote conveying passage including a first passage plate and a second passage plate which are oppositely arranged to form a banknote passing gap between the first passage plate and the second passage plate, wherein the first passage plate and the second passage plate are respectively butt jointed with two lateral edges of the banknote inlet of the box body;

a conveying mechanism arranged at the banknote conveying passage at a position close to the banknote inlet and including a driving shaft roller configured to be driven by an external power, a steering shaft roller assembled with the driving shaft roller by an interference fit, an outlet driving shaft roller away from the banknote inlet and assembled with the steering shaft roller by an interference fit, and a flapping vaned wheel coaxially arranged with the outlet driving shaft roller; and a banknote stacking plate supported by a spring to be installed on a bottom plate, opposite to the banknote inlet, in the box body and slidable up and down, wherein the banknote stacking plate and one end of the first passage plate are oppositely arranged, a side, facing the banknote stacking plate, of the first passage plate is provided with a guiding elastic piece, and a Y-shaped passage having an opening facing an entrance of the banknote conveying passage is formed by the guiding elastic piece and the banknote stacking plate.

Preferably, an included angle ranging from 15 degrees to 75 degrees is formed between the banknote stacking plate and a placement plane of the banknote collecting and recycling box.

Preferably, rib strips having tooth-shaped grooves are provided on a side, facing the banknote conveying passage, of the box body.

Preferably, a sliding groove configured to allow the banknote stacking plate to slide up and down is provided in the box body.

Preferably, one end, close to the banknote inlet, of the guiding elastic piece is fixed to the first passage plate, and the guiding elastic piece extends obliquely toward the banknote stacking plate to allow another end of the guiding elastic piece to be close to a lateral wall, facing the banknote conveying passage, of the box body.

Furthermore, two of the guiding elastic pieces are uniformly distributed on a top portion of the banknote accommodating space.

Preferably, an installation bottom of the box body is provided with two magnetic suction plates, and a magnetic force combination is formed by the two magnetic suction plates with a magnetic body on an installation device for the banknote collecting and recycling box.

The banknote collecting and recycling box has the following advantages compared with the conventional technology.

The banknote stacking plate is obliquely arranged in the banknote collecting and recycling box and the Y-shaped passage having the opening facing the entrance of the banknote conveying passage is formed by the guiding elastic piece and the banknote stacking plate, and thus the entered banknotes can be stably stacked on the banknote stacking plate and an influence on a subsequent piece of banknote, such as blocking and friction, caused by the surfaces of the banknotes already stacked on the banknote stacking plate is decreased. Specially, the following problem can be avoided that the conveying and orderly stacking of the subsequent piece of banknote is badly affected if the previous piece of banknote has a fold, a crack or a corrugation.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

DETAILED DESCRIPTION

For further illustrating a preferable banknote collecting and recycling box according to the present application, detailed description will be further made in conjunction with drawings in a preferable embodiment of the present application.

Figure 1:
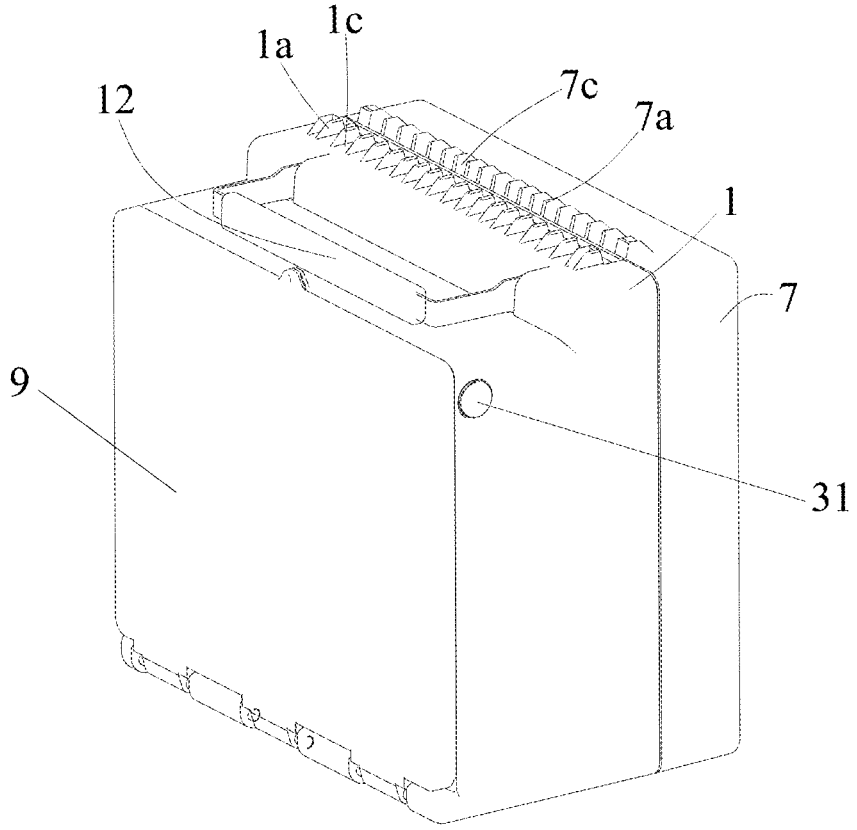
FIG. 1. is a perspective view of a banknote collecting and recycling box for a financial device according to the present application.
Figure 2:
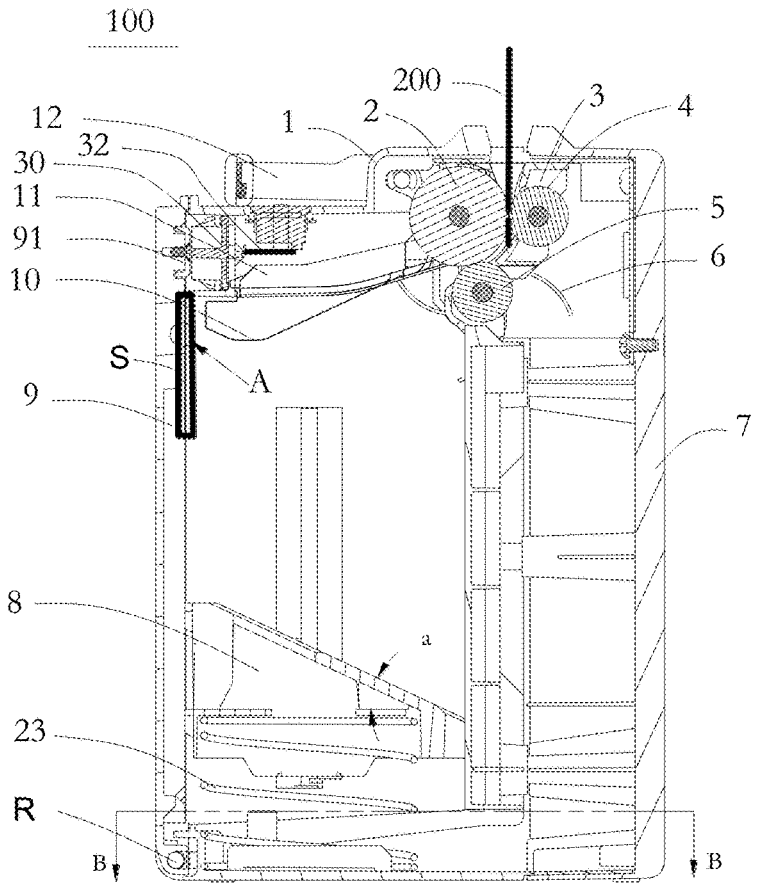
FIG. 2 is a schematic sectional view of a box body of the recycling box as shown in FIG. 1.

As shown in FIGS. 1 and 2, a banknote collecting and recycling box 100 includes a box body. The box body includes a movable door body 9 which can be opened and closed by rotation, an intermediate housing 1 and a bottom housing 7. The following components are installed inside the box body and thus form a banknote accommodating space. The intermediate housing 1 is located at an intermediate position of the box body. The bottom housing 7 is located at the right side of the intermediate housing 1 and is connected to the intermediate housing 1 by screws (not shown). The door body 9 is located at the left side of the intermediate housing 1 and can be opened by rotating anticlockwise around a bottom rotating shaft R. An upper portion of the door body 9 is connected by a lock-tongue holder 91 to a lock-tongue 30 installed on the intermediate housing 1. The door body 9 can be unlocked by pressing a lock-tongue end surface 31 or by rotating a key to drive a lock-tongue catch 32. When the door body 9, the intermediate housing 1 and the bottom housing 7 of the recycling box 100 are installed in place, all corresponding outer surfaces are flush with each other.

A banknote inlet configured to allow entrance of banknotes is provided between surfaces of same ends of the intermediate housing 1 and the bottom housing 7. First guiding teeth 1*a* are provided on an outer side of the intermediate 1 at positions close to the banknote inlet. Second guiding teeth 7*a* are provided on an outer side of the bottom housing 7 at positions close to the banknote inlet. The first guiding teeth 1*a* and the second guiding teeth 7*a* are in clearance fit with grooves of an external banknote conveying passage which is butt jointed with the recycling box 100. Groove portions 1*c* between every two adjacent teeth of the first guiding teeth 1*a* and groove portions 7*c* between every two adjacent teeth of the second guiding teeth 7*a* are in clearance fit with protruding portions of the external banknote conveying passage. A transfer passage for introducing the banknotes into the recycling box 100 is formed by the first and second guiding teeth.

A banknote conveying passage is provided inside the box body of the recycling box 100. The banknote conveying passage includes a first passage plate 11 and a second passage plate 3 which are oppositely arranged to form a banknote passing gap between the first passage plate 11 and the second passage plate 3. The first passage plate 11 and the second passage plate 3 are respectively butt jointed with two lateral edges of the banknote inlet of the box body, to allow the banknote conveying passage inside the box body to successfully butt joint the external banknote conveying passage. The recycling box 100 further includes a conveying mechanism arranged at the banknote conveying passage at a position close to the banknote inlet. The conveying mechanism includes a driving shaft roller 4 driven by a power source, a steering shaft roller 2 assembled with the driving shaft roller 4 by an interference fit, an outlet driving shaft roller 5 away from the banknote inlet and assembled with the steering shaft roller 2 by an interference fit, and a flapping vaned wheel 6 coaxially arranged with the outlet driving shaft roller 5. For allowing the steering shaft roller 2 to be in contact with each of the driving shaft roller 4 and the outlet driving shaft roller 5 by an interference fit, an avoiding gap corresponding to the steering shaft roller 2 is provided in the first passage plate 11, and avoiding gaps respectively corresponding to the driving shaft roller 4, the outlet driving shaft roller 5 and the vaned wheel 6 are provided in the second passage plate 3. For enabling the entered banknotes 200 to be reliably steered, the steering shaft roller 2 is designed to have a large size, and the diameter of the steering shaft roller 2 is designed as about 30 mm in this embodiment. For decreasing the loading of the recycling box, the driving shaft roller 4 at the inlet is designed to have a small size, and the diameter of the driving shaft roller 4 is designed as about 18 mm in this embodiment. The steering shaft roller 2 is in contact with both the driving shaft roller 4 and the outlet driving shaft roller 5 by an interference fit, but the driving shaft roller 4 is not in contact with the outlet driving shaft roller 5, thus a reliable clamping force is formed for clamping the banknotes passing therethrough.

Figure 3:
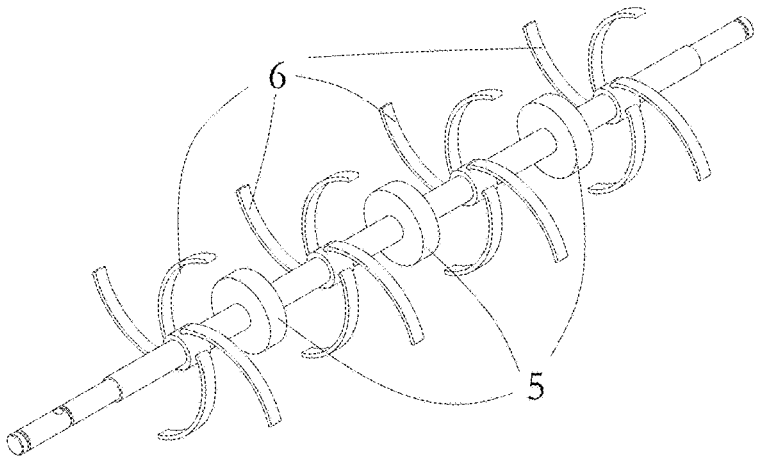
FIG. 3 is a perspective schematic view showing an outlet driving shaft roller as shown in FIG. 2.

In this embodiment, generally two to four conveying rubber wheels are uniformly distributed on each of the steering shaft roller 2, the driving shaft roller 4 and the outlet driving shaft roller 5, to ensure the clamping force for conveying banknotes 200, and at the least two conveying rubber wheels are required. Vaned wheels 6 which are arranged on the outlet driving shaft roller 5 and staggered from the conveying rubber wheels 65 are illustrated in FIG. 3.

The inside of the box body of the recycling box 100 is further provided with a banknote stacking plate 8. The banknote stacking plate 8 is supported by a return spring 23 to be installed on a bottom plate opposite to the banknote inlet in the box body, and is slidable up and down. The banknote stacking plate 8 and one end of the first passage plate 11 are oppositely arranged, and a side of the first passage plate 11 facing the banknote stacking plate 8 is provided with a guiding elastic piece 10. A Y-shaped passage having an opening facing an entrance of the banknote conveying passage is formed by the guiding elastic piece 10 and the banknote stacking plate 8. One end, close to the banknote inlet, of the guiding elastic piece 10 is fixed to the first passage plate 11, and the guiding elastic piece 10 extends obliquely toward the banknote stacking plate 8 to allow another end of the guiding elastic piece 10 to be close to a lateral wall of the box body facing the banknote conveying passage, and the lateral wall is the door body 9. Two guiding elastic pieces 10 are uniformly distributed on a top portion of the banknote accommodating space.

As shown in FIG. 2, an included angle α is defined between the banknote stacking plate 8 and a placement plane of the banknote collecting and recycling box, and the included angle α ranges from 15 degrees to 75 degrees. When selecting the included angle α, practical requirements such as a maximum track of the vaned wheels 6 in rotation, a banknote stacking capacity and a maximum outline size of the recycling box 100 should also be taken into consideration. The banknote stacking plate 8 which is designed to be inclined has the following functions. 1. A flapping space is provided for the vaned wheels 6 to make the best use of the vaned wheels 6. 2. The Y-shaped passage is formed between the banknote stacking plate 8 and the guiding elastic piece 10 to facilitate the entrance of the banknotes 200. 3. Influence caused by the surface quality of a previous piece of banknote is decreased. The principle of the technical solution is as follows. A subsequent piece of banknote enters the banknote stacking space along a surface of the previous piece of banknote already stacked on the banknote stacking plate 8. If the previous piece of banknote has a poor surface quality such as it has a fold, a crack and a corrugation, the conveying and stacking of the subsequent piece of banknote will be seriously affected. The existence of the included angle α allows the previous piece of banknote to have only a part of surface to be in contact with the subsequent piece of banknote, and thus a risk that the banknotes cannot enter the banknote stacking space and are not orderly stacked is decreased.

Figure 4:
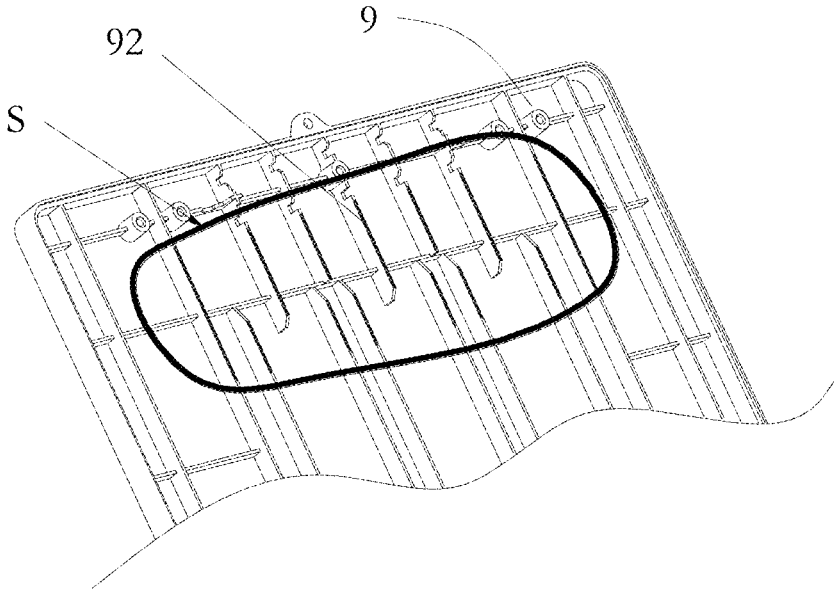
FIG. 4 is a partial schematic view showing an inner side surface of a door body as shown in FIG. 2.
Figure 5:
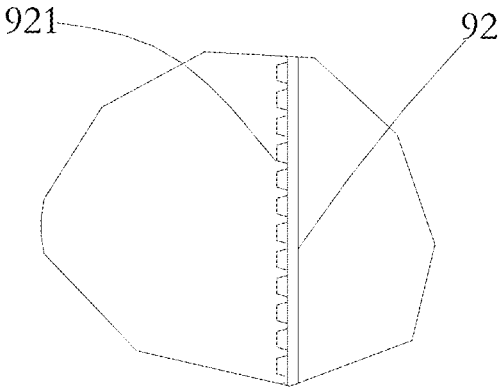
FIG. 5 is an enlarged schematic view of portion A in FIG. 1.

As shown in FIG. 4, rib strips 92 having tooth-shaped grooves 921 are provided on a side, facing the banknote conveying passage, of the door body 9. Each of the tooth-shaped grooves 921 starts from a top portion of the guiding elastic piece 10 and ends at a lower portion of the banknote stacking plate 8 when a top surface of the banknote stacking plate 8 is at an upper limit position. The shape of the tooth-shaped groove 921 is shown in FIG. 5. In a case that no such tooth-shaped grooves 921 are provided, after the banknote 200 hits against the rib strips 92 in the door body 9, the banknote 200 slides downward along a surface of the rib strips 92 and thus the banknote is caused to be erect in the box body of the recycling box 100. The tooth-shaped grooves 921 can effectively prevent such cases from occurring. The effect of the tooth-shaped grooves 921 can be described in following two cases. In a first case, if a front end of the banknote 200 hits against the bottoms of the tooth-shaped grooves 921, the banknote will not have a too large displacement due to the limitation to the front end of the banknote from the tooth-shaped grooves 921, and when the vaned wheels 6 flap a rear end of the banknote, the whole piece of banknote falls freely toward the banknote stacking plate 8. In a second case, when the front end of the banknote 200 hits against planes of top portions of the tooth-shaped grooves 921, the banknote 200 slides downward into the bottoms of the tooth-shaped grooves 921, and the following process is the same as the first case. Thus it can effectively ensure that the banknotes can be orderly stacked on the banknote stacking plate 8.

Figure 6:
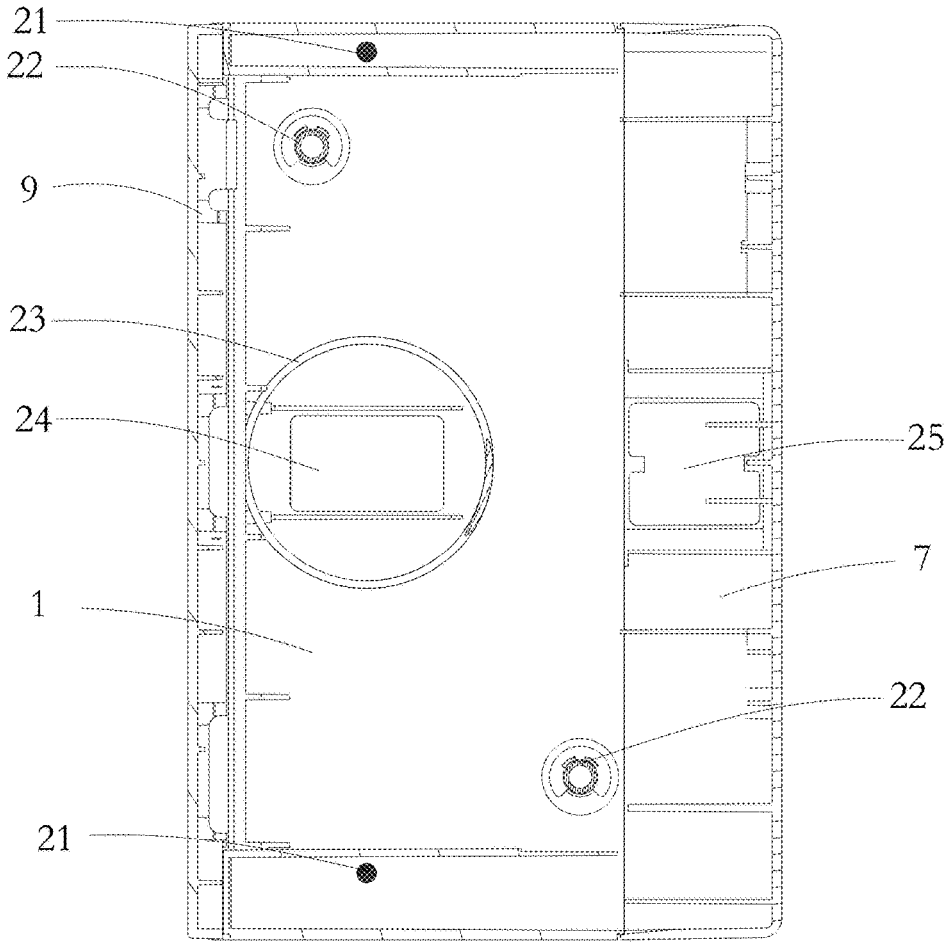
FIG. 6 is a schematic sectional view taken along the line B-B in FIG. 2.
Figure 7:
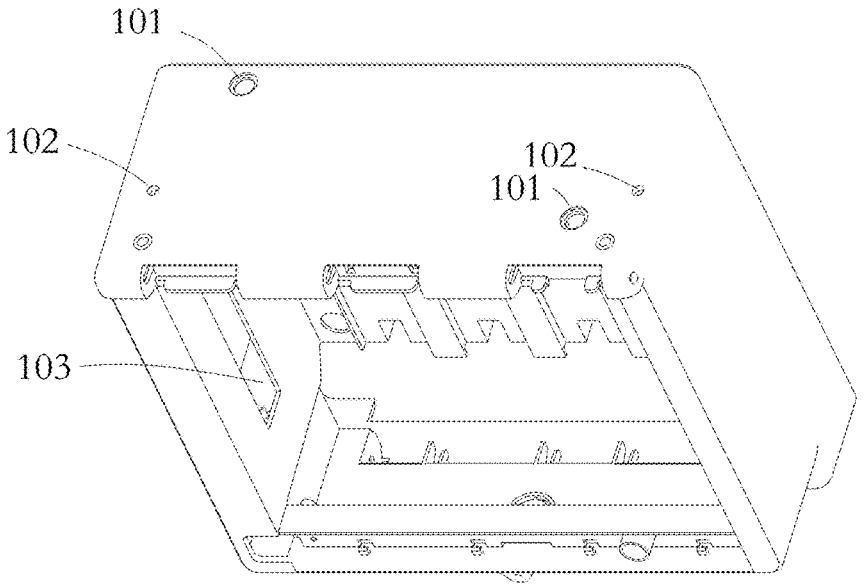
FIG. 7 is a schematic view of an intermediate housing as shown in FIG. 2.

As shown in FIGS. 1, 6 and 7, the banknote stacking plate 8 can slide up and down along a stacking plate guiding shaft 21 installed in the intermediate housing 1. The stacking plate guiding shaft 21 is inserted into the intermediate housing 1 through a hole 102 in the intermediate housing 1 and is fixed, and a gap 103 configured for installing the stacking plate 8 is provided in an inner cavity of the intermediate housing 1 at a position corresponding to the stacking plate guiding shaft 21. From the above description it can be concluded that, the intermediate housing 1 has multiple functions, thus greatly decreasing the number of parts and fasteners and the product cost.

As shown in FIGS. 6 and 7, a bottom of the recycling box 100 is provided with two through holes 101, and limit pins 22 configured to limit the box body on a holder are installed in the two through holes 101. The bottom of the recycling box 100 is further provided with a first magnetic suction plate 24 and a second magnetic suction plate 25, and magnetic force combinations are formed by the first magnetic suction plate 24 and the second magnetic suction plate 25 with respective magnetic bodies on an installation holder of the financial self-service device, and thus a suction force generated by the magnetic force combinations can ensure the box body to be reliably positioned. The recycling box 100 is fixed by a magnetic force, which effectively resolves the defects of a lock catch (sometimes providing lock catches at two sides) fixing manner which is generally used in the box body. The defects are as follows, the lock catch is required to be fastened during the installation and the lock catch is required to be unlocked first before it is pulled out, and sometimes the unfastened lock catch may hit against other parts to be broken. In the present application, a power system has a small load, and magnets and magnetic suction plates are reasonably designed to completely meet the practical requirements. Furthermore, the limit pins 22 ensure the accuracy of the installation position of the box body.

For facilitating processes such as installation operation and carrying operation of the recycling box, the recycling box is further provided with a handle 12. An off-center design of the handle 12 ensures that after the handle 12 is released from a vertical position, the handle 12 can automatically return to a horizontal position as shown in FIG. 1.

For better describing a conveying process of the banknote collecting and recycling box according to this embodiment, a detailed description will be made in conjunction with FIGS. 2 and 8 to 10.

Figure 8:
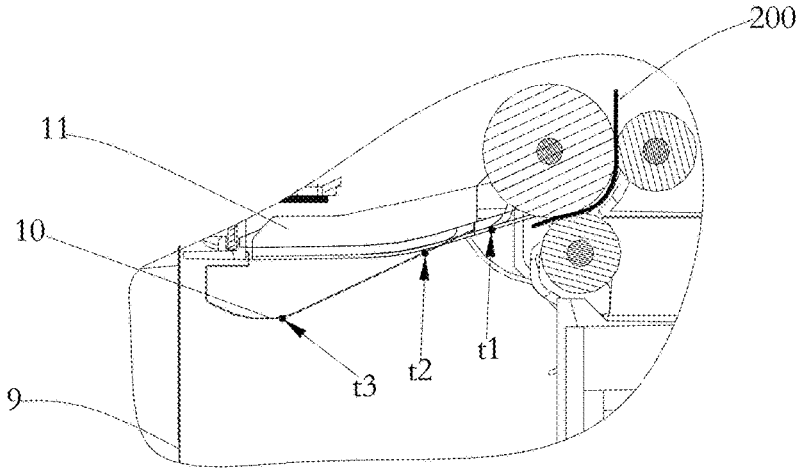
FIG. 8 is a schematic view showing collision points when banknotes enter the recycling box as shown in FIG. 1.

Reference is made to FIGS. 2 and 8. The banknote 8 is clamped and conveyed by the conveying mechanism into the box body, and after the front end of the banknote 200 comes into contact with a point t1 on the first passage plate 11 and points t2 and t3 on the guiding elastic piece 10 successively, the front end of the banknote 200 hits against the tooth-shaped grooves 921 in an S area on the door body 9. The first passage plate 11 is made of plastic and the guiding elastic piece 10 is made of spring steel sheet, and the elasticity of the spring steel sheet can assist in stacking the banknotes. It should be noted that all the contacting points and hitting points are random. However, for the convenience of description, the most possible contacting and hitting points have been illustrated as shown in FIG. 8.

Figure 9:
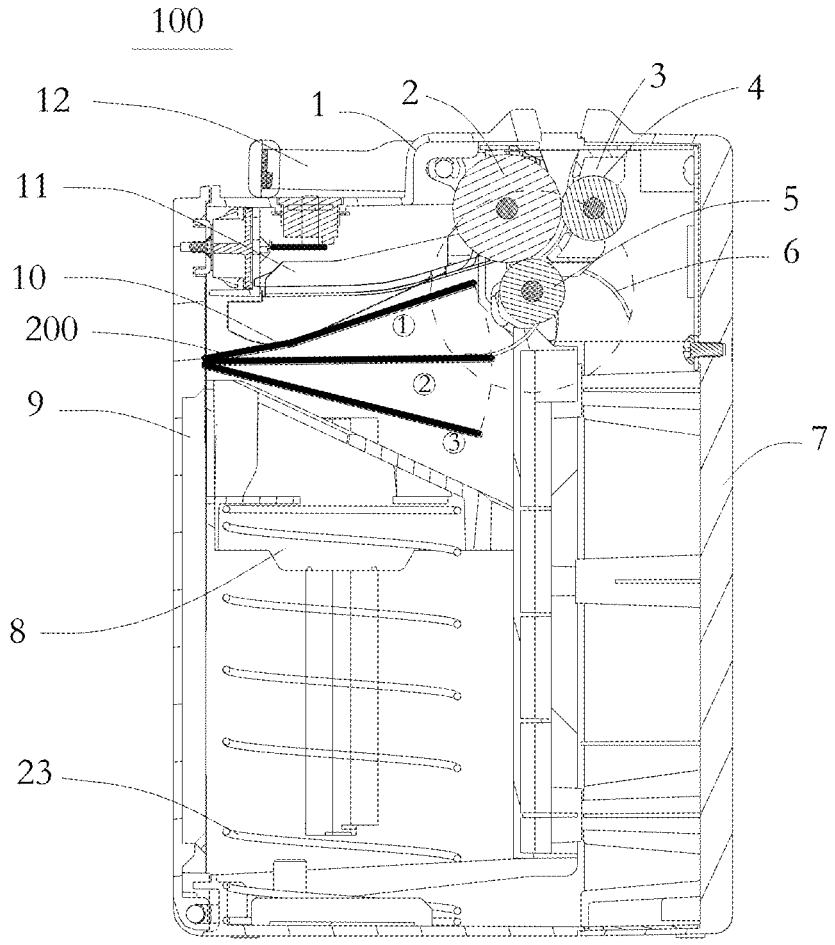
FIG. 9 is a schematic view showing a banknote stacking device of the recycling box as shown in FIG. 1.

As shown in FIG. 9, due to the limitation of the tooth-shaped grooves 921 in the door body 9, the rear end of the banknote 200 is flapped by the synchronous vaned wheels 6 on the outlet driving shaft roller 5 to allow the banknote 200 to rotate around the front end of the banknote 200. Furthermore, due to a banknote accommodating space T provided by an inclined surface of the banknote stacking plate, the banknote freely rotates after the rear end of the banknote leaves a circular track formed by the flapping of the vaned wheels 6 and finally falls onto a working surface of the banknote stacking plate. Three positions of the same piece of banknote at different moments are illustrated in FIG. 9. A position ① illustrates that the front end of the banknote 200 hits against the tooth-shaped grooves 921 of the door body 9; a position ② illustrates the banknote 200 at the moment when the rear end of the banknote 200 is flapped by the vaned wheels 6; and a position ③ illustrates that the banknote 200 freely falls down after the rear end of the banknote 200 leaves the vaned wheels 6.

Figure 10:
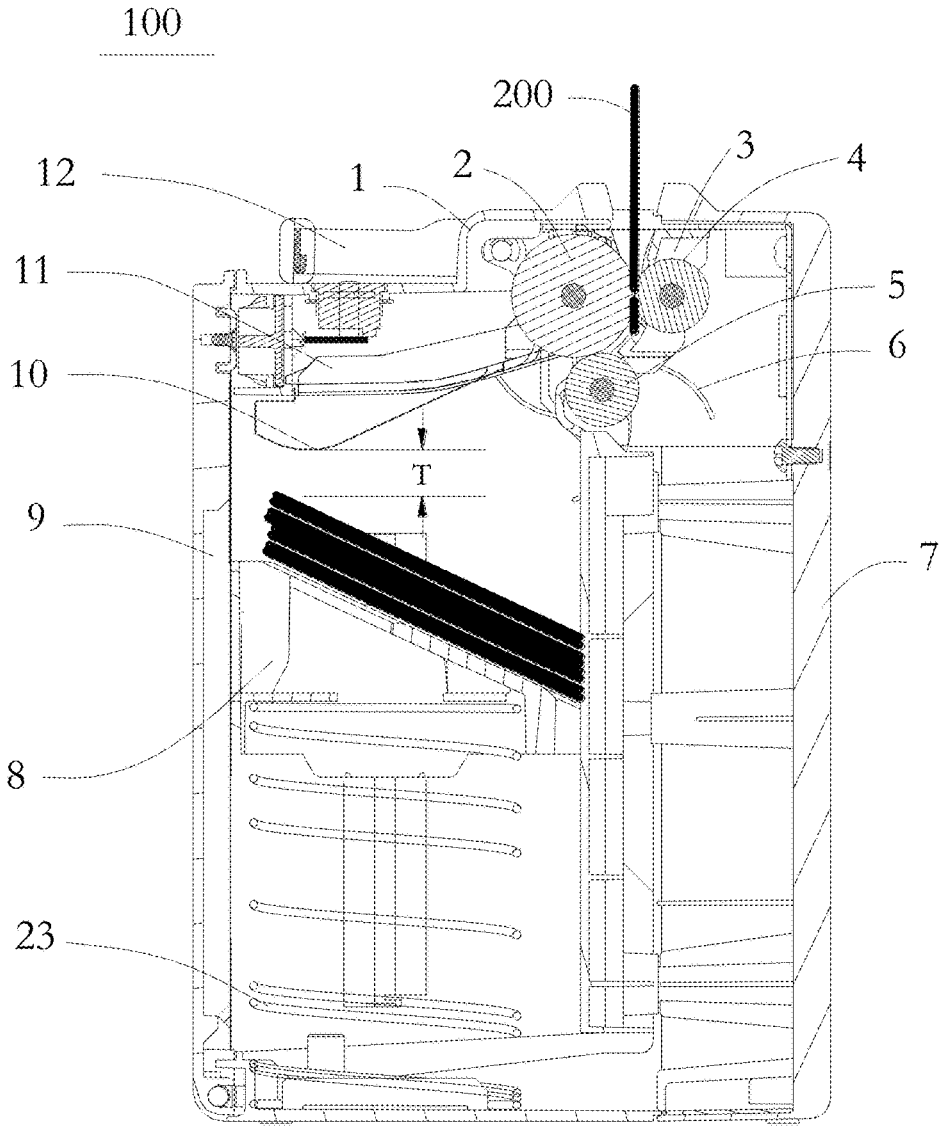
FIG. 10 is a schematic view showing the sliding of a banknote stacking plate in the recycling box as shown in FIG. 1.

As the banknotes continually enter the box body, more and more banknotes are stacked on the stacking plate 8. Under the action of its own weight and the weight of the banknotes, the return spring 23 of the stacking plate 8 is compressed to remain a banknote entering space between the guiding elastic piece 10 and a top portion of the stack of banknotes, as shown in FIG. 10.

After the banknotes stacked on the stacking plate 8 are taken out, the box body returns to a state ready for introducing banknotes as shown in FIG. 2 under the action of the return spring 23.

The above descriptions are only preferable embodiments of the present application. It should be noted that the preferable embodiments should not be interpreted as limitation to the present application. The scope of protection of the present application is defined by the claims. For those ordinary skilled in the art, several modifications and improvements may be made to the present application without departing from the spirit and scope of the present application, and these modifications and improvements should also be deemed to fall into the scope of protection of the present application.

The invention claimed is:

1. A banknote collecting and recycling box comprising:

a box body comprising a movable door body, wherein the following components are installed inside the box body to form a banknote accommodating space, and a banknote inlet configured to allow entrance of banknotes is provided in the box body;

a banknote conveying passage comprising a first passage plate and a second passage plate which are oppositely arranged to form a banknote passing gap between the first passage plate and the second passage plate, wherein the first passage plate and the second passage plate are respectively butt jointed with two lateral edges of the banknote inlet of the box body;

a conveying mechanism arranged at the banknote conveying passage at a position close to the banknote inlet and comprising a driving shaft roller configured to be driven by an external power, a steering shaft roller assembled with the driving shaft roller by an interference fit, an outlet driving shaft roller away from the banknote inlet and assembled with the steering shaft roller by an interference fit, and a flapping vaned wheel coaxially arranged with the outlet driving shaft roller; and a banknote stacking plate supported by a spring to be installed on a bottom plate, opposite to the banknote inlet, in the box body and slidable up and down, wherein an included angle ranging from 15 degrees to 75 degrees is formed between the banknote stacking plate and a placement plane of the banknote collecting and recycling box; the banknote stacking plate and one end of the first passage plate are oppositely arranged, a side, facing the banknote stacking plate, of the first passage plate is provided with a guiding elastic piece, and a Y-shaped passage having an opening facing an entrance of the banknote conveying passage is formed by the guiding elastic piece and the banknote stacking plate.

2. The banknote collecting and recycling box according to claim 1, wherein rib strips having tooth-shaped grooves are provided on a side, facing the banknote conveying passage, of the box body.

3. The banknote collecting and recycling box according to claim 1, wherein a sliding groove configured to allow the banknote stacking plate to slide up and down is provided in the box body.

4. The banknote collecting and recycling box according to claim 1, wherein one end, close to the banknote inlet, of the guiding elastic piece is fixed to the first passage plate, and the guiding elastic piece extends obliquely toward the banknote stacking plate to allow another end of the guiding elastic piece to be close to a lateral wall, facing the banknote conveying passage, of the box body.

5. The banknote collecting and recycling box according to claim 4, wherein two of the guiding elastic pieces are uniformly distributed on a top portion of the banknote accommodating space.

6. The banknote collecting and recycling box according to claim 1, wherein an installation bottom of the box body is provided with two magnetic suction plates, and a magnetic force combination is formed by the two magnetic suction plates with a magnetic body on an installation device for the banknote collecting and recycling box.

* * * * *